United States Patent [19]

Legg nee Jouve et al.

[11] 3,968,815

[45] July 13, 1976

[54] BRANCH FITTINGS FOR HYDRAULIC STACK APPARATUSES WITH GYROLAMINARY FLOW FOR USE IN BUILDINGS

[76] Inventors: Monique Legg née Jouve, 3, Avenue Anatole; Georges Richard, 51, Avenue St-Jerome, both of 13 Aix-en-Provence, France

[22] Filed: Dec. 23, 1974

[21] Appl. No.: 535,783

[52] U.S. Cl. ..... 137/602; 4/211

[51] Int. Cl.[2] ..... E03C 1/222

[58] Field of Search ..... 137/602; 4/209, 211, 4/219

[56] References Cited

UNITED STATES PATENTS

| | | | |
|---|---|---|---|
| 452,023 | 5/1891 | Crittenden | 4/209 |
| 577,793 | 2/1897 | Stewart | 4/211 |
| 1,186,280 | 6/1916 | Carson | 4/211 |
| 3,711,128 | 1/1973 | Hezel | 4/211 |

FOREIGN PATENTS OR APPLICATIONS

| | | |
|---|---|---|
| 710,177 | 5/1968 | Belgium |
| 6,618,021 | 6/1968 | Netherlands |

*Primary Examiner*—Robert G. Nilson
*Attorney, Agent, or Firm*—Raymond A. Robic; Arthur Schwartz; Peter G. Mack

[57] ABSTRACT

This invention is concerned with a branch fitting for hydraulic stack apparatuses with gyro-laminary ventilated flow for use in buildings, the fitting comprising a fitting body provided with an inlet and an outlet for connecting vertical stack portions respectively thereto. At least one branch pipe inlet is disposed in tangential relationship to the body for connecting a branch-pipe thereto, the tangential inlet serving to admit liquids which are to be evacuated into the stack, the body and the tangential inlet being constructed to maintain, at all times, a constant link between air above the liquid in the branch-pipe and air in the stack.

6 Claims, 13 Drawing Figures

BRANCH FITTINGS FOR HYDRAULIC STACK APPARATUSES WITH GYROLAMINARY FLOW FOR USE IN BUILDINGS

The present invention relates to branch fittings for hydraulic stack apparatuses with gyro-laminary flow for use in buildings. These branch fittings are used with a view to replace the secondary ventilation piping system external to the stack, by a secondary internal ventilation without pipes and inside the stack.

Such apparatuses known by the Applicants' Belgian Pats. Nos. 710.177 of Jan. 31, 1968 and 733.880 of May 30, 1969, which disclose branch fittings having several branch-pipes for tangential injection of fluids evacuated into the stack, to create a ventilated gyratory movement.

For these branch fittings, the Applicants have already proposed various different apparatuses such as:

a. Concentric tympanums, the axes of which are parallel to the vertical axis of the stack, placed at the openings to the branch-pipe outlets and attached to the wall on the upper side of the gyration to promote a gyratory movement.
b. Blades cutting the fluid film so as to promote openings which create an intercommunication between the central air core in the stack and the air in the branch-pipes.
c. Blades curved vertically in the general direction of gyration to produce or regenerate the gyratory movement.
d. Funnel shaped braking surfaces concentric to the stack.
e. Secondary branch-pipes for waste water.

It is an object of the present invention to improve the efficiency of the fittings so as to allow them to receive super-abundant flows and to avoid the risk of unpriming. The possible unpriming occurs, on the one hand, of self-unpriming of a syphone which is used for draining a given appliance and, on the other hand, by way of so-called "induced" unpriming if a series of appliances are joined together on the same collector before injection into the branch fitting.

To this end, Applicants propose to provide a branch fitting comprising a fitting body formed with an inlet and an outlet for connecting vertical stack portions respectively thereto and at least one inlet tangential to said body for connecting a branch-pipe to admit liquids to be evacuated into said stack, the body and the tangential inlet being constructed to maintain a constant link between air above the liquid in the branch-pipe and air in the stack in all cases of liquid discharge.

Various embodiments of the subject invention will now be described with reference to the appended drawings, wherein:

FIGS. 8, 8A, 9 and 9A are in accordance with the prior art.

Figure 1:
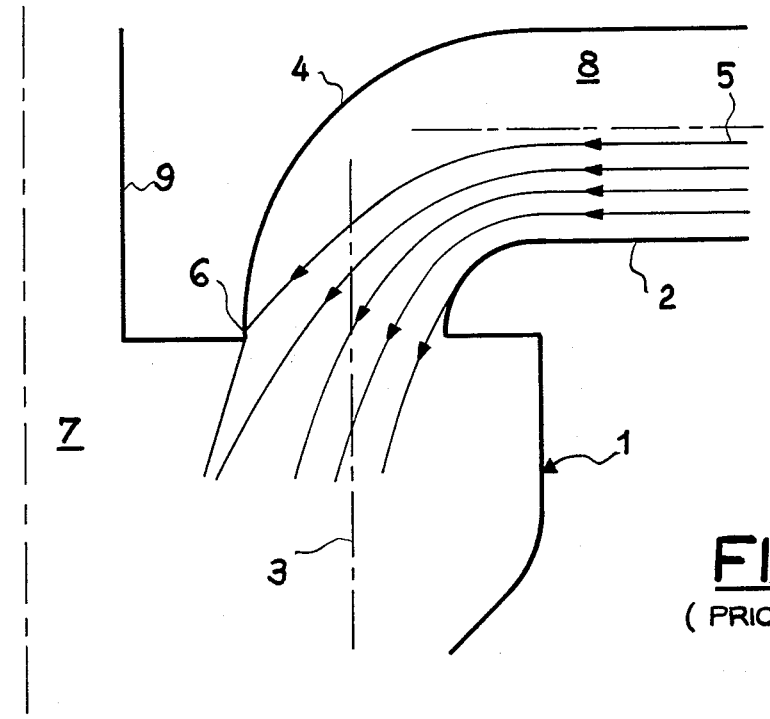
FIG. 1 ( PRIOR ART )
FIGS. 1 to 4, 6 and 11 are schematic elevation views of branch fittings, the branch fittings represented in FIGS. 1 and 3 being known in the art.

Referring first to FIG. 1, the branch fitting represented comprises a body 1 interconnecting the branch-pipe 2 of a toilet or of another appliance to the vertical stack 9.

It can be seen that, in the branch-pipes used at the present time, in order for the waste water stack to create a gyro-laminary ventilated discharge, the water brought into the outlets by vertical axis 3 comes from a collector which is generally horizontal (described by branch-pipe 2) and which is joined to body 1 by an elbow 4 in order to send the flow from an horizontal direction to a vertical direction.

When the evacuated discharges become superabundant, the upper thin jets of water 5 of the evacuated liquid strike the opposite wall 6 of elbow. This results in an obstruction of the discharge collector 2 arriving in the branch-pipe and impedes intercommunication between the air 7 of the center of the vertical stack 9 and the air 8 contained in branch-pipe 2 above the liquid flowing in this branch-pipe.

Figure 2:
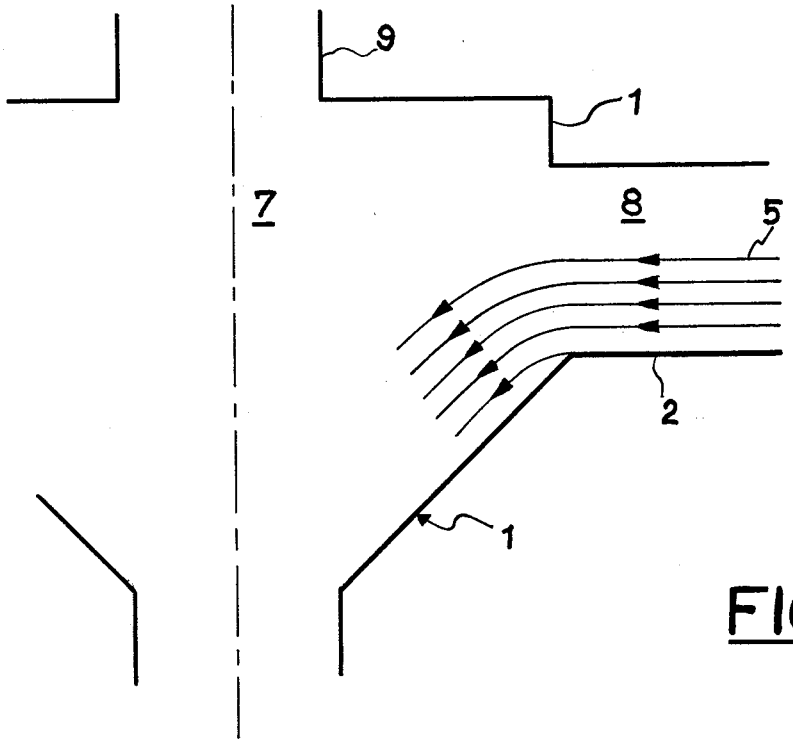

Referring now to FIG. 2, illustrating a device which is constructed according to the invention and in which will overcome this drawback, the branch-pipe 2 is joined to body 1 in such a way that the liquid is injected directly into the body along an horizontal axis. In this way, it is unlikely that branch-pipe 2 will encounter a surface which could disturb the flow of the thin upper jets 5. Thus, the air 8 above the injected fluid remains constantly linked with air core 7 in the vertical stack 9.

Figure 3:
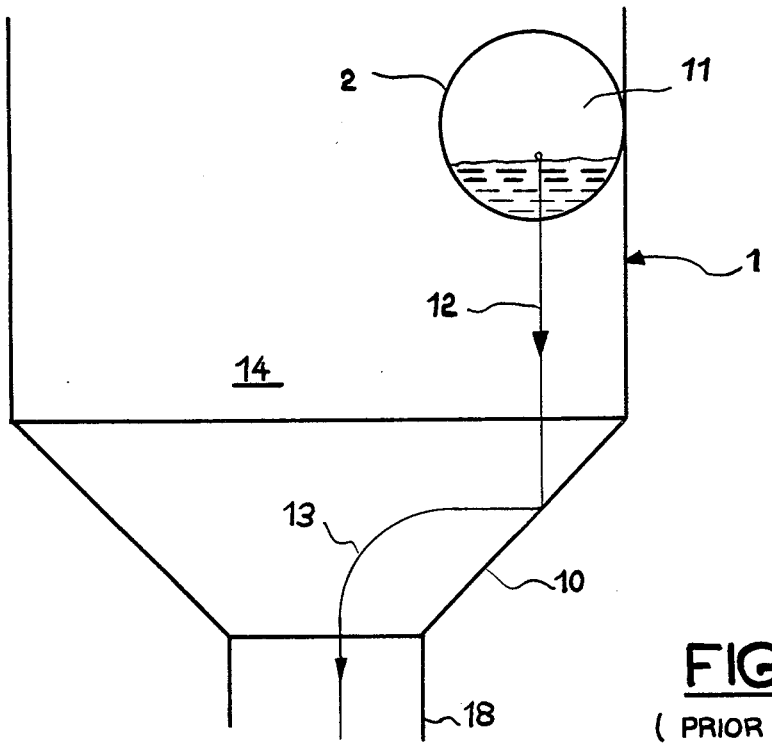
FIG. 3 ( PRIOR ART )
Figure 4:
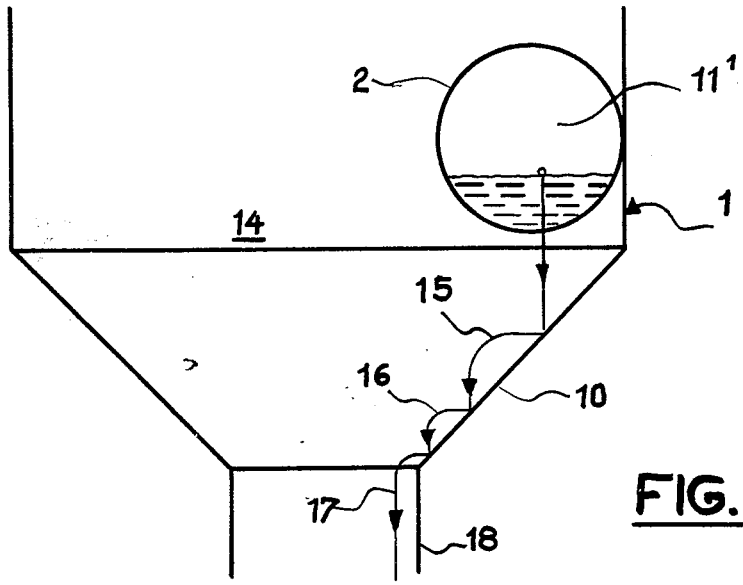

FIGS. 3 and 4 show a branch fitting in which the body 1 has an inclined funnel-shaped braking surface 10.

With reference to FIG. 3, when the liquid is injected into branch fitting 1 through inlet 11 from branch-pipe 2, the aperture of which is relatively high above the braking surface 10, the liquid emerges horizontally above the surface 10 and then falls onto this surface. If the height of the stack between the thin liquid jet and the braking surface is significant, the thin jet will fall, following trajectory 12 and rebounds into the stack following trajectory 13. The air core 14 at atmospheric pressure can then become blocked by such projections if these are abundant.

FIG. 4 shows a branch fitting in which, according to the invention, the tangential injection is made by aperture $11^1$ arriving in the body as near as possible to the start of the braking surface 10. Thus, the thin jet cannot fall from a great height onto braking surface 10. It rebounds according to trajectories 15 and 16 onto the braking surface and then runs along the interior wall of the principal down-pipe 18 following trajectory 17. There is then less risk of disturbing the atmospheric pressure inside the air core in the stack when the discharges become superabundant.

Figure 5:
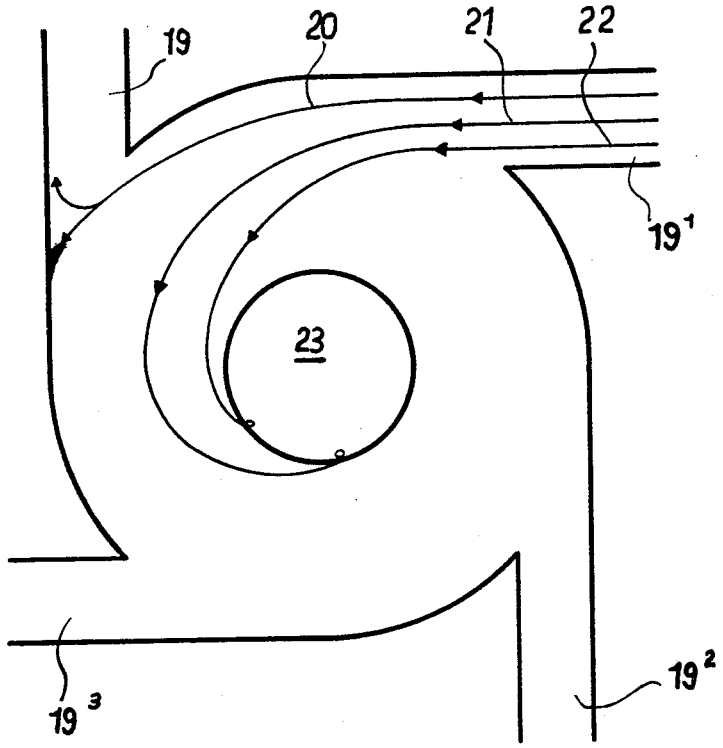
FIG. 5 (PRIOR ART)
FIGS. 5 and 7 are schematic plan views of branch-fittings, the branch fitting represented in FIG. 5 being known in the art.
Figure 6:
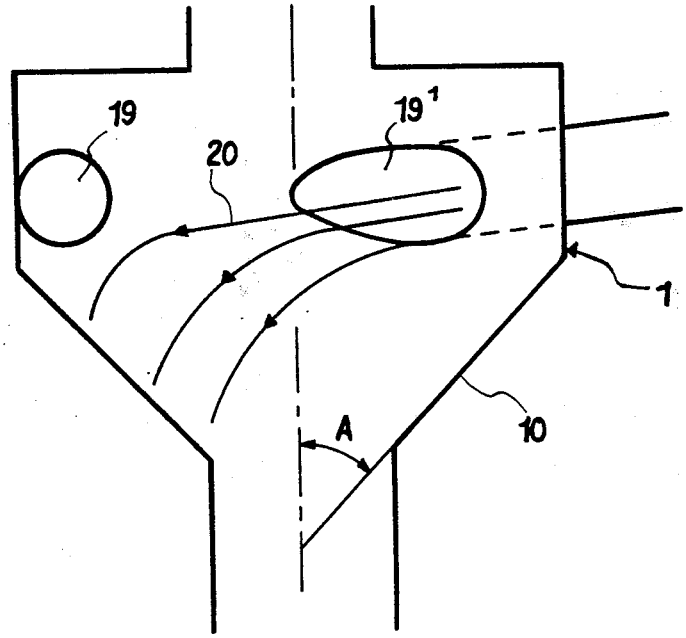

With reference to FIGS. 5 and 6, when several inlets 19, $19^1$, $19^2$, and $19^3$ emerge tangentially in the branch fitting and in the immediate vicinity of the braking surface 10, and substantially on the same horizontal level, it is possible when the discharges become superabundant that the thin liquid jets 20 injected through inlet $19^1$ have a tendency to partially return into inlet 19, while the other thin jets 21–22 follow their normal trajectory to accomplish the ventilated gyro-laminary flow desired.

If the extent of flow of thin jets back into inlet 19 is significant, a problem arises, for inlet 19 becomes filled which creates the risk that it may also be blocked. This would cause an obstruction between the air in branch-pipe 19 and the air in the central core of stack 23.

In accordance with the invention, this difficulty can be overcome in two ways:

A. Referring to FIG. 6, Applicants establish a brake owing to fact that the generating line of the funnel 10 is sufficiently inclined towards the bottom so that the highest liquid jet 20 emerging from inlet $19^1$ is below the lower generating line of the next succesive inlet 19 when it passes in front of this inlet. The brake must be constructed in such a way that the angle A which it makes with he axis of the stack, is less than 65°.

Figure 7:
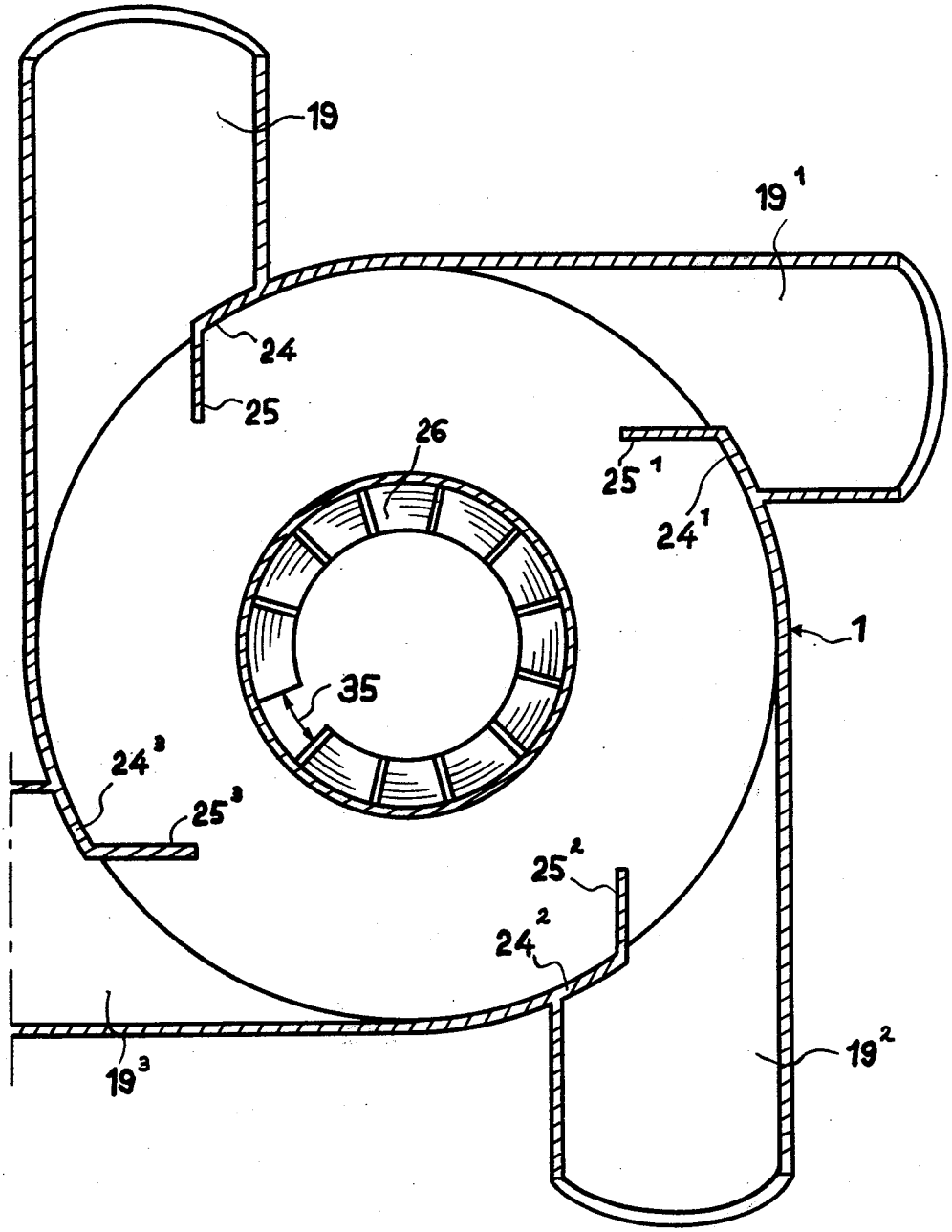

B. Referring to FIG. 7, at the extremity of tympanums 24, $24^1$, $24^2$, and $24^3$ facilitating the gyratory injections, Applicants place blades 25, $25^1$, $25^2$, and $25^3$ which are substatially and which are directed towards the axis of the stack and designed to redirect the liquid jets as far as possible, otherwise, when the jets are ejected from inlet $19l^1$ they might enter the next successive inlet 19 if blade 25 at the extremity of tympanum 24 did not prevent this.

When the discharges become superabundant in the vertical stack, the means used to create the gyro-laminary ventilated flow become overbodied one after the other. At that time it can be noticed that the set of blades placed at the entrance to the branch fitting still manage to maintain the gyratory movement of the liquid flowing verticaly in the stack but no longer manage to produce in the laminary film the formation of voids used to ensure intercommunication between the air of the central core and the air from the branch-pipes entering the vertical stack.

Figure 8:
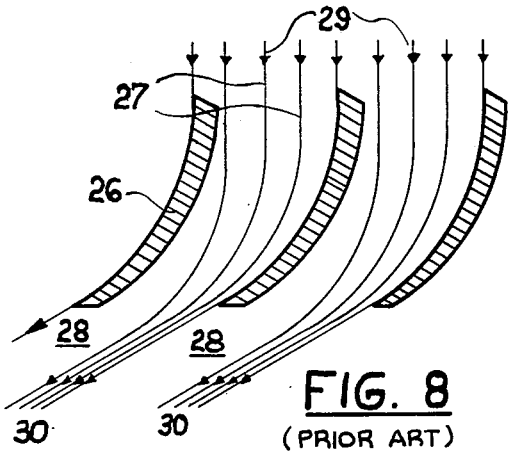
FIG. 8 (PRIOR ART)
FIGS. 8, 8A, 9, 9A and 10 are laminar flow schematic illustrations, where
Figure 8A:
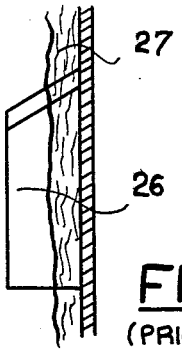
FIG. 8A (PRIOR ART)

FIGS. 8 and 8A show a gyro-laminary film 27 of normal thickness, passing through a portion of a set of blades 26.

The film emerges, after following a substantially vertical direction 29 and after impinging and accumulating on the blades 26, in the direction 30 in flat layers, leaving between them voids 28.

Figure 9:
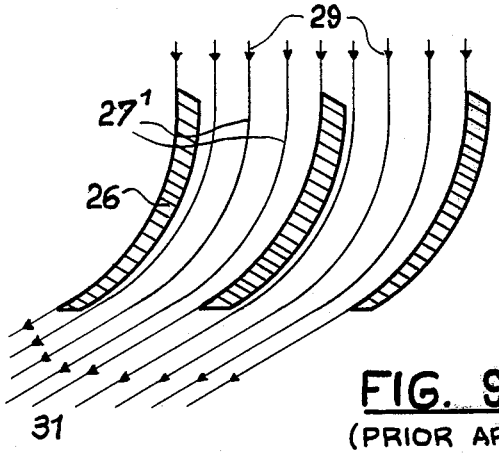
FIG. 9 (PRIOR ART)
Figure 9A:
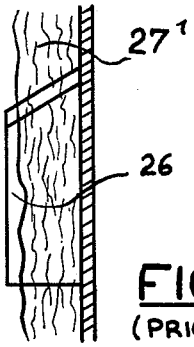
FIG. 9A (PRIOR ART)

FIGS. 9 and 9A represent a superabundant gyro-laminary film whose width $27^1$ is abnormally large. It is noted that the liquid films, which emerge after following a vertical direction 29 no longer break sufficiently onto the blade 26 and come out simply deviated in a direction 31 with a greater thickness $27^1$ in the region of the blade which deviated them. The intercommunication voids 28 of FIG. 8 have thus completely disappeared while the gyratory movement is maintained.

The intercommunication voids must be maintained, and, to ensure this, Applicants, according to the invention, have created, between two successive blades which are normally spaced, a greater spacing disrupting the normal distribution and allowing laminated flow of the liquid layers without diverting them.

In other words, Applicants modify the regular and normal distribution and this modification is advantageously obtained by eliminating one blade.

Figure 10:
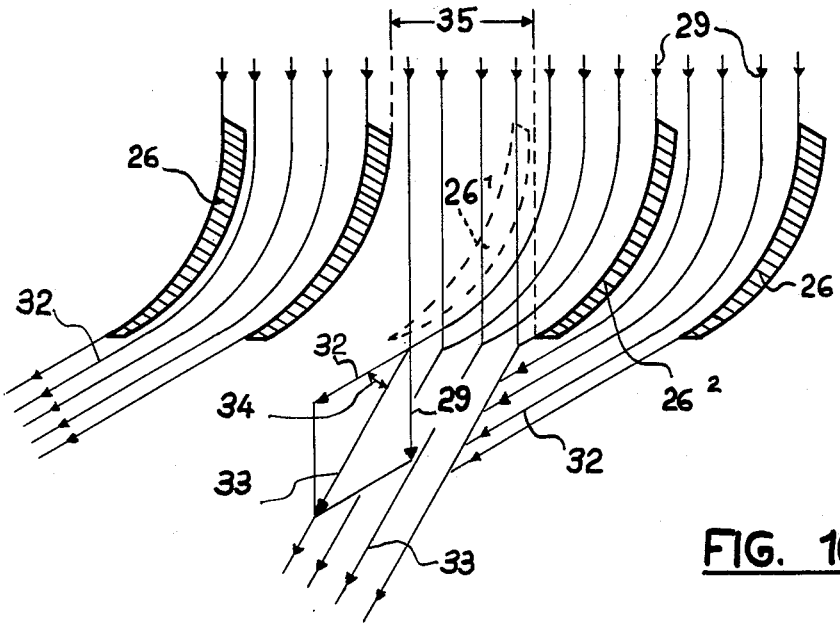

In FIG. 10, the blade which has been eliminated is represented in dotted line $26^1$.

Under these conditions, the liquid arriving normally to follow direction 29, on blade 26 is diverted following direction 32 by the blades 26, but here, at $26^1$ a blade is missing, and the liquid arriving in this spot will not be diverted. This liquid will come up against the liquid diverted by blade 26 and will penetrate following a resultant direction 33.

The angle 34, on the one hand, between the liquid layers, following direction 33 and, on the other hand, those following direction 32 will correspond to zone 28 having no liquid, and in this manner intercommunication will be maintained. The space 35 which is between the leading edge of one blade and the tailing edge of the preceding blade is equal to at least 2% of the outer perimeter of crown 26.

Figure 11:
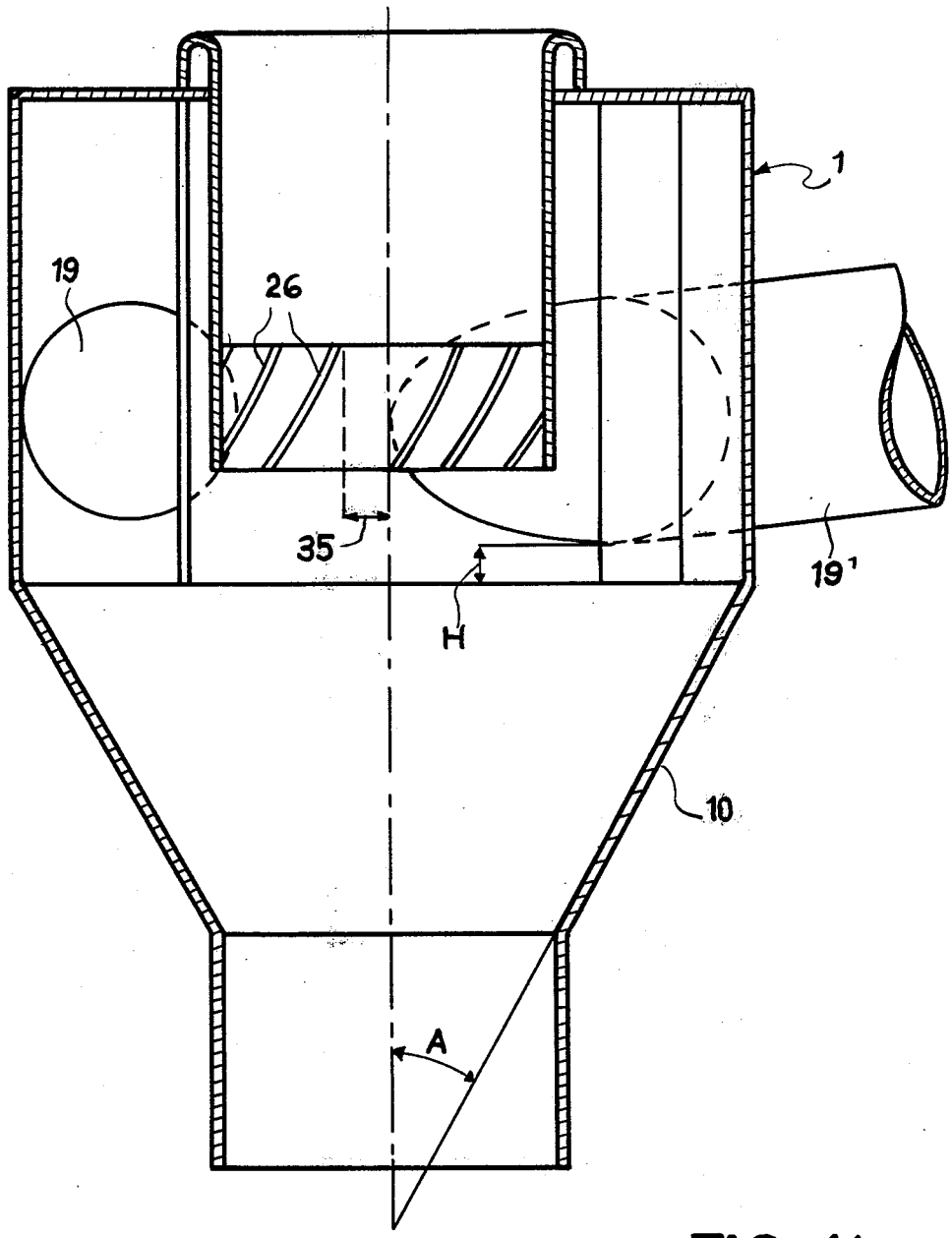

Applicants have shown in FIGS. 7 and 11 a branch fitting which comprises together different characteristics separately represented in FIGS. 1 to 6 and 8 to 10 respectively FIG. 7 is a cross sectional view taken through the vertical axis of the stack.

FIG. 11 shows a vertical cross section.

FIG. 7 illustrates: the set of blades 26 which were represented in FIGS. 8, 9 and 10 with interval 35 between two successive blades, the tympanums 24 with ramps 25, and also the inlets 19 with substantially horizontal axes, placed tangentially to the vertical stack.

FIG. 11 shows the set of blades 26 with interruption 35, the inlet of branch $19^1$ being at a low height H above the braking surface, 94 at angle A the axis of the stack, which angle is less than 65°.

We claim:

1. A branch fitting for hydraulic stack apparatuses with gyro-laminary ventilated flow for use in buildings, the fitting comprising, a fitting body provided with an inlet and an outlet for connecting vertical stack portions respectively thereto and at least one inlet tangential to said body for connecting a branch-pipe which admits liquid into said stack, said body having a downwardly converging, inlcined braking surface in the shape of a funnel with a top edge and a bottom edge, said tangential inlet being disposed adjacent said top edge of said braking surface, said braking surface being longer between its top edge and bottom edge than the greatest vertical dimension of said inlet, whereby a constant link is maintained between air above the liquid in said branch-pipe and air in said stack.

2. The branch fitting of claim 1, wherein the branch-pipe is connected to the fitting body in a manner such that the liquid is injected through the tangential inlet directly into the body along a horizontal axis.

3. The branch fitting of claim 1, wherein the body is provided with several tangential inlets substantailly on a same horizontal level and wherein said braking surface forms an angle of less than 65° with respect to the vertical axis of the stack.

4. A branch fitting for hydraulic stack apparatuses with gyro-laminary ventilated flow for use in buildings comprising, a fitting body provided with an inlet and an outlet for connecting vertical stack portions respectively thereto and at least one inlet tangential to said body for connecting a branch-pipe which admits liquid into said stack, said tangential inlet being provided with a typanum for facilitating gyratory injection of liquid, said tympanum being provided with a substantially vertical ramp extending from the typanum toward the vertical axis of the stack for redirecting the injected liquid as far as possible and preventing injected liquid from flowing into the tangential inlet from the fitting body, whereby a constant link is maintained between air above the liquid in said branch-pipe and air in said stack.

5. A branch fitting for hydraulic stack apparatuses with gyro-laminary ventilated flow for use in buildings, comprising, a fitting body provided with an inlet and an outlet for connecting vertical stack portions respectively thereto and at least one inlet tangential to said body for connecting a branch-pipe which admits liquid into said stack, said fitting body having an inner periphery and a plurality of blades spacedly and successively disposed along said inner periphery and below said tangential inlet, one spacing being followed by a further spacing equal to twice said one spacing.

6. The branch fitting of claim 5, wherein the distance between the inner end of one blade and the outer end of the next blade, taken along a horizontal plane, is equal to at least 2% of said inner periphery when said one blade and said next blade are spaced apart by a value equal to said further spacing.

* * * * *